US009153175B2

(12) United States Patent
Song et al.

(10) Patent No.: US 9,153,175 B2
(45) Date of Patent: Oct. 6, 2015

(54) DISPLAY DEVICE AND METHOD FOR COMPENSATION OF IMAGE DATA OF THE SAME

(71) Applicant: Samsung Display Co., Ltd., Yongin, Gyeonggi-Do (KR)

(72) Inventors: In-Bok Song, Yongin (KR); Choong-Sun Shin, Yongin (KR)

(73) Assignee: Samsung Display Co., Ltd., Gyeonggi-Do (KR)

( * ) Notice: Subject to any disclaimer, the term of this patent is extended or adjusted under 35 U.S.C. 154(b) by 0 days.

(21) Appl. No.: 14/062,656

(22) Filed: Oct. 24, 2013

(65) Prior Publication Data

US 2014/0347403 A1 Nov. 27, 2014

(30) Foreign Application Priority Data

May 22, 2013 (KR) ..... 10-2013-0057812

(51) Int. Cl.
*G09G 3/32* (2006.01)
*G09G 5/10* (2006.01)

(52) U.S. Cl.
CPC ..... *G09G 3/3258* (2013.01); *G09G 3/3216* (2013.01); *G09G 5/10* (2013.01); *G09G 2300/043* (2013.01); *G09G 2320/0204* (2013.01); *G09G 2320/045* (2013.01); *G09G 2320/046* (2013.01)

(58) Field of Classification Search
USPC ..... 345/690, 501–522, 600; 382/269, 232, 382/254
See application file for complete search history.

(56) References Cited

U.S. PATENT DOCUMENTS

| | | | | |
|---|---|---|---|---|
| 2006/0061593 | A1* | 3/2006 | Miura et al. | 345/612 |
| 2007/0126661 | A1* | 6/2007 | Kao et al. | 345/63 |
| 2009/0015601 | A1* | 1/2009 | Kim | 345/690 |
| 2009/0189840 | A1* | 7/2009 | Chu et al. | 345/89 |

FOREIGN PATENT DOCUMENTS

| | | | |
|---|---|---|---|
| KR | 10-2006-0092239 | A | 8/2006 |
| KR | 10-2008-0007254 | A | 1/2008 |
| KR | 10-2009-0012381 | A | 2/2009 |
| KR | 10-2010-0037114 | A | 4/2010 |
| KR | 10-2011-0102697 | A | 9/2011 |

* cited by examiner

*Primary Examiner* — Srilakshmi K Kumar
*Assistant Examiner* — Deeprose Subedi
(74) *Attorney, Agent, or Firm* — Knobbe Martens Olson & Bear LLP

(57) ABSTRACT

A display device and an image compensation method are disclosed. One inventive aspect includes a controller and a data driver. The controller processes image data signal based on at least one of pixel information, a reference brightness condition, a present brightness of the display device and a target luminance and generate final compensated data. The pixel information is measured under the reference brightness condition. The data driver transmits the final compensated data to an activated driving pixel.

17 Claims, 6 Drawing Sheets

DISPLAY DEVICE AND METHOD FOR COMPENSATION OF IMAGE DATA OF THE SAME

CROSS-REFERENCE TO RELATED APPLICATIONS

This application claims priority to and the benefit of Korean Patent Application No. 10-2013-0057812 filed in the Korean Intellectual Property Office on May 22, 2013, the entire contents of which are incorporated herein by reference.

BACKGROUND

1. Field

The disclosed technology generally relates to a display device including an image compensation system and a method for compensating images to be displayed.

2. Description of the Related Technology

An organic light emitting diode (OLED) is a self-luminance element that makes a phosphorous material emit light by re-combination of electrons and holes. Thus, unlike a passive light emission element that requires an additional light source like a liquid crystal display, OLED technology has fast response time and requires low DC driving voltage. In addition, OLEDs can be formed into slim profiles so that they can be applied in a wall mounted or portable display device.

OLEDs are generally classified into passive matrix type organic light emitting diodes (PMOLEDs) and active matrix type organic light emitting diode (AMOLEDs) that use a TFT to drive each OLED pixel. A PMOLED forms a positive electrode and a negative element which perpendicularly cross each other and selects a line for driving. An AMOLED connects a TFT and a capacitor to an ITO pixel electrode to maintain a voltage.

A display device using OLED pixels has a luminance difference due to non-uniform deterioration or aging of the pixels. Such a luminance non-uniformity may also naturally occur in chemical batch characteristics or performance of OLED materials.

Various methods for reducing screen non-uniformity due to luminance difference between pixels have been researched. It is known that when luminance non-uniformity of a display device is modulated based on data measured in a specific screen brightness, the non-uniformity can be reduced for brightness when the data is measured. However, the improvement can be inefficient or the non-uniformity can increase for brightness other than the brightness when the data is measured. Therefore, a method for reducing the luminance non-uniformity for any brightness condition is desirable.

The above information disclosed in this Background section is only for enhancement of understanding of the background of the invention and therefore it may contain information that does not form the prior art that is already known in this country to a person of ordinary skill in the art.

SUMMARY OF CERTAIN INVENTIVE ASPECTS

Embodiments of the disclosed technology disclose a display device that includes an image compensation system. The image compensation system compensates image data to provide the same compensation effect in any brightness condition.

In addition, embodiments of the disclosed technology include a method of compensating image data that can eliminate luminance non-uniformity of a display device without regard to an external brightness condition of the display device.

A display device according to embodiments of the disclosed technology displays an image by transmitting an image data signal from an external source to each pixel of a display unit including pixels.

In details, the display device includes: a first scaling unit receiving the image data signal, and generating first compensation data by compensating the image data signal corresponding to a reference brightness at the time that pixel information with respect to the plurality of pixels is measured, a compensation circuit unit compensating gray data of the first compensation data and generating second compensation data to display a target luminance according to the image data signal using the pixel information measured in the reference brightness condition, a second scaling unit generating third compensation data by compensating the second compensation data corresponding to the present brightness of the display device, and a data driver enabling displaying of an image by transmitting the third compensation data to an activated corresponding driving pixel among the plurality of pixels.

The first scaling unit and the second scaling unit may be operation circuits that perform calculation using a compensation rate to which a ratio of the present brightness of the display unit with respect to the reference brightness is reflected.

The first scaling unit may generate the first compensation data by multiplying the compensation rate to which a ratio of the present brightness of the display unit with respect to the reference brightness is reflected to the image data signal, and the second scaling unit may generate the third compensation data by dividing the second compensation data with the compensation rate.

The pixel information is a parameter provided for image data compensation, and is not restrictive. In particular, the pixel information may be a parameter that compensates a luminance difference between a luminance value output from the original gray data of the image data signal and a target luminance value, caused by a material characteristic, a manufacturing environment, and a structural characteristic of the plurality of pixels.

The first scaling unit may be connected to a front end of the compensation circuit unit and the second scaling unit may be connected to a rear end of the compensation circuit unit.

The display device may further include a scan driver sequentially activating the plurality of pixels by transmitting scan signals to the corresponding pixels, respectively, and a controller receiving the image data signal from the external source and a control input signal for controlling image data of the image display signal and performing a processing process on the image data signal. The controller includes a first scaling unit, a compensation circuit, and a second scaling unit.

A display device according to another exemplary embodiment of the disclosed technology displays an image by transmitting an image data signal to each pixel of a display unit including a plurality of pixels. The display device includes: a scaling unit acquiring pixel information measured in a predetermined brightness condition and converting the measured pixel information according to the present brightness condition of the display unit, a compensation circuit unit receiving the image data signal from an external source and generating an output image data signal by compensating the image data display to display a target luminance according to the image data signal using the pixel information converted by the scaling unit, and a data driver enabling displaying of an image by transmitting the output image data signal to the corresponding activated driving pixel among the plurality of pixels.

An image compensation method according to another exemplary embodiment of the disclosed technology compensates an image data signal in a display device that displays an image by transmitting the image data signal to each pixel of a display unit including a plurality of pixels.

In detail, the image compensation method includes: measuring pixel information with respect to the plurality of pixels in a predetermined reference brightness, calculating a compensation rate to which a ratio of the present brightness of the display unit with respect to the reference brightness, performing a first compensation process corresponding to the reference brightness by applying the compensation rate to the image data signal input from an external source, performing a second compensation process to display a target luminance according to the image data signal using the pixel information with respect to first output data according to the first compensation process, performing a third compensation process corresponding to the present brightness of the display device by applying the compensation rate to second output data according to the second compensation process, and displaying an image by transmitting third output data according to the third compensation process to each of the plurality of pixels.

The performing the first compensation process may be performing an operation for multiplying the compensation rate to the image data signal, and the performing the third compensation process may be performing an operation for dividing the second output data with the compensation rate.

In addition, an image compensation method according to another exemplary embodiment of the disclosed technology compensates an image data signal in a display device displaying an image by transmitting the image data signal to each pixel of a display unit including a plurality of pixels. The image compensation method may include: measuring pixel information with respect to the plurality of pixels in a predetermined reference brightness condition, acquiring the pixel information and converting the pixel information according to the present brightness condition of the display unit, performing compensation for displaying a target luminance according to the image data signal input from an external source using the converted pixel information with respect to the image data signal, and displaying an image by transmitting a compensation data signal of the image data signal, compensated in the compensation process to each of the plurality of pixels.

One aspect of the disclosed technology is a display device for displaying an image by transmitting an image data signal from an external source to a display unit including pixels. The display device comprises a controller and a data driver. The controller is configured to receive the image data signal. The controller is further configured to process the image data signal based at least in part on pixel information, a reference brightness condition, a present brightness of the display device and a target luminance, and generate final compensated data. The pixel information is measured under a reference brightness condition. The data driver is configured to transmit the final compensated data to an activated driving pixel of the pixels.

Another aspect of the disclosed technology is a display device for displaying an image by transmitting an image data signal from an external source to a display unit including pixels. The display device comprises a controller and a data driver. The controller is configured to receive the image data signal. The controller is further configured to process the image data signal based at least in part on pixel information, a predetermined brightness condition, a present brightness condition of the display unit and a target luminance, and generate output image signal. The pixel information is measured under a predetermined brightness condition. The data driver is configured to transmit the output image data signal to an activated driving pixel of the pixels.

Another aspect of the disclosed technology is an image compensation method of compensating an image data signal in a display device that displays an image by transmitting the image data signal from an external source to a display unit including pixels. The image compensation method comprises measuring pixel information of the pixels in a reference brightness and calculating a compensation rate based at least in part on a ratio between a present brightness of the display unit and the reference brightness. The image compensation method further comprises performing a first compensation process by applying the compensation rate to the image data signal and generating first output data and performing a second compensation process based at least in part on the pixel information, the first output data and a target luminance to generate second output data. In addition, the image compensation method comprises performing a third compensation process by applying the compensation rate to the second output data based at least in part on the present brightness and the second output data to generate third output data and displaying the image by transmitting the third output data to each of the pixels.

Another aspect of the disclosed technology is an image compensation method of compensating an image data signal in a display device for displaying an image by transmitting the image data signal from an external source to a display unit including pixels. The image compensation method comprises measuring pixel information of pixels under a reference brightness condition and acquiring the pixel information and converting the pixel information based at least in part on a present brightness condition of the display unit. The image compensation method further comprises performing a compensation for a target luminance based at least in part on the image data signal and the converted pixel information and displaying the image by transmitting a compensated image data signal to the pixels.

According to the display device and the image compensation method of the disclosed technology, the same image data can be effectively compensated in any brightness condition of an external environment so that luminance non-non-uniformity of the display device can be stably improved.

In addition, high-quality image can be provided by eliminating screen non-uniformity in the display device so that manufacturing yield of the display unit can be increased and the product quality can be improved.

DETAILED DESCRIPTION OF CERTAIN INVENTIVE EMBODIMENTS

Figure 1:
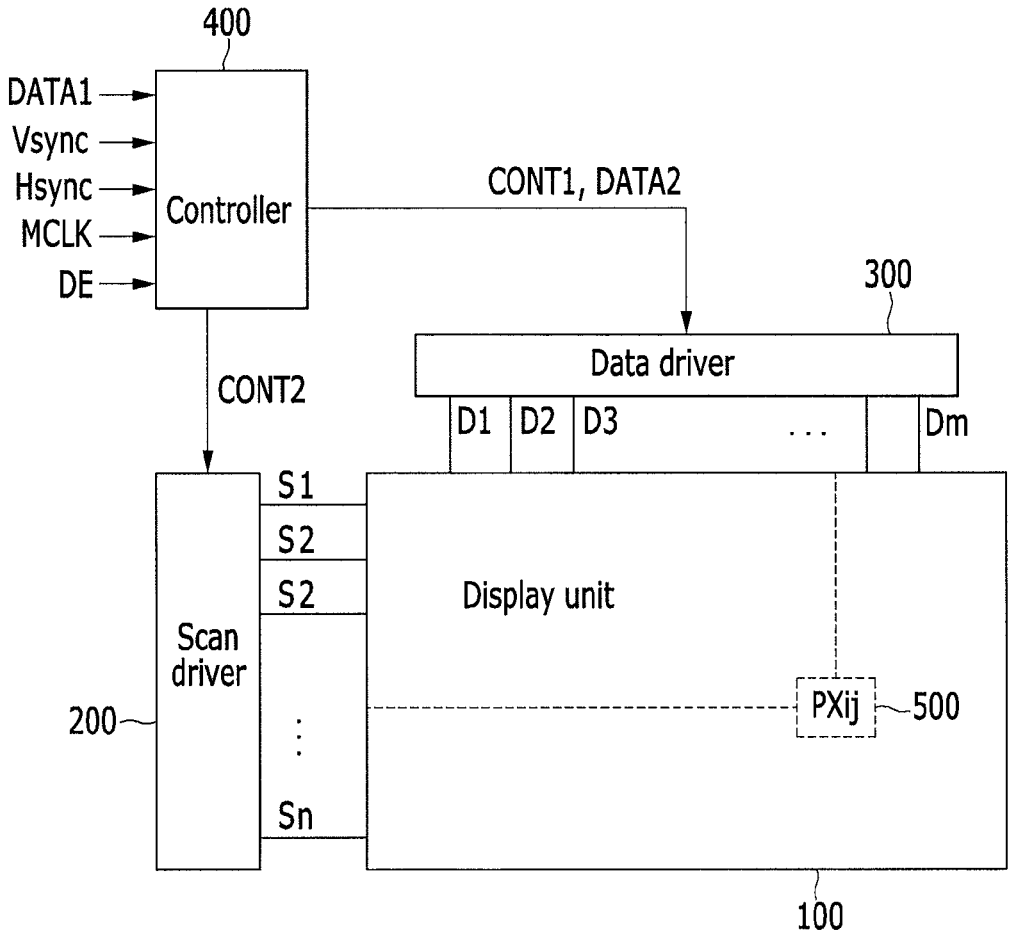
FIG. 1 is a block diagram of a display device according to an exemplary embodiment of the disclosed technology.

The disclosed technology will be described more fully hereinafter with reference to the accompanying drawings, in which exemplary embodiments of the invention are shown. As those skilled in the art would realize, the described embodiments may be modified in various different ways, all without departing from the spirit or scope of the disclosed technology.

Accordingly, the drawings and description are to be regarded as illustrative in nature and not restrictive. Like reference numerals designate like elements throughout the specification.

In the drawings, the thickness of layers, films, panels, regions, etc., are exaggerated for clarity. In the drawings, for better understanding and ease of description, the thicknesses of some layers and areas are exaggerated. It will be understood that when an element such as a layer, film, region, or substrate is referred to as being "on" another element, it may be directly on the other element or intervening elements may also be present.

Throughout this specification and the claims that follow, when it is described that an element is "connected" to another element, the element may be "directly connected" to the other element or "electrically connected" to the other element through a third element. In addition, unless explicitly described to the contrary, the word "comprise" and variations such as "comprises" or "comprising" will be understood to imply the inclusion of stated elements but not the exclusion of any other elements. Throughout this specification, it is understood that the term "on" and similar terms are used generally and are not necessarily related to a gravitational reference.

Here, when a first element is described as being connected to a second element, the first element may be not only directly connected to the second element but may also be indirectly connected to the second element via a third element. Further, some of the elements that are not essential to the complete understanding of the disclosed technology are omitted for clarity. Also, like reference numerals refer to like elements throughout.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

FIG. 1 is a block diagram of a display device according to an exemplary embodiment of the disclosed technology.

Referring to FIG. 1, the display device includes a display unit 100 including pixels 500, a scan driver 200, a data driver 300, and a controller 400.

The display unit 100 is a display unit including the pixels 500. Each of the pixels 500 connects to a corresponding one of scan lines S1-Sn and a corresponding one of data lines D1-Dm. Each of the pixels displays an image corresponding to an image data signal transmitted to it.

The pixels 500 of the display unit 100 are connected to the scan lines S1 to Sn and the data lines D1 to Dm and substantially arranged in a matrix format. The scan lines S1-Sn are extended substantially in a row direction and mostly in parallel with each other. The data lines D1-Dm are substantially extended in a column direction and mostly in parallel with each other. Each pixel of the display unit 100 is driven by receiving a driving power source voltage from an external power source device.

The scan driver 200 is connected to the display unit 100 through the scan lines S1-Sn. The scan driver 200 generates scan signals that can activate the pixels of the display unit 100 according to the scan control signal CONT2. The scan driver 200 transmits the scan signal to a corresponding one of the scan lines S1 to Sn.

The scan control signal CONT2 is an operation control signal of the scan driver 200. The scan control signal CONT2 is generated and transmitted from the controller 400. The scan control signal CONT2 may include a scan start signal SSP, a clock signal CLK, and the like. The scan start signal SSP is a signal generating the first scan signal for displaying an image of one frame. The clock signal CLK is a synchronization signal for sequential application of the scan signals to the scan lines S1-Sn.

The data driver 300 connects to each pixel of the display unit 100 through the data lines D1-Dm. The data driver 300 receives the image data signal DATA2 and transmits the received image data signal DATA2 to the corresponding one of data lines D1 to Dm according to the data control signal CONT1.

The data control signal CONT1 is an operation control signal of the data driver 300. The data control signal CONT1 is generated and transmitted from the controller 400.

The data driver 300 selects a gray voltage according to the image data signal DATA2 to the data lines D1 to Dm. The image data signal DATA2 has been processed by the controller 40 and thus have luminance data compensated. Here, the image data signal DATA2 is a third compensation data signal that has passed through a third compensation process. The third compensation process is the final stage of the image processing process included in the image compensation system of the controller 400. The image compensation process of the controller 400 will be described in detail hereinafter with reference to the accompanying drawing.

The controller 400 receives an image source data DATA1 input from an external source and an input control signal. The input control signal controls displaying of the image source data. The image source data DATA1 contains luminance data of each pixel of the display unit 100, in which luminance may be classified into a predetermined number of grays, for example, 1024 (−210), 256 (=28), or 64 (=26) grays. The image source data DATA1 performs an image processing process with respect to the luminance data and transmits the compensated image data signal DATA2 to the data driver 300. The luminance data include the luminance information through the image compensation system of the controller 400. The image compensation system of the controller 400 according to an exemplary embodiment of the disclosed teachology, will be described in detail with reference to FIG. 2 and FIG. 6.

Meanwhile, the input control signal transmitted to the controller 400 exemplarily includes a vertical synchronization signal Vsync, a horizontal synchronization signal Hsync, a main clock signal MCLK, a data enable signal DE and the like.

The controller 400 performs an image processing on the input image source data DATA1 according to the operation condition of the display unit 100 and the data driver 300 and based on the input control signal.

In addition, the controller 400 transmits the scan control signal CONT2 to the scan driver 200. The scan control signal CONT2 controls the operation of the scan driver 200. The controller 400 generates the data control signal CONT1 that controls the operation of the data driver 300.

Figure 2:
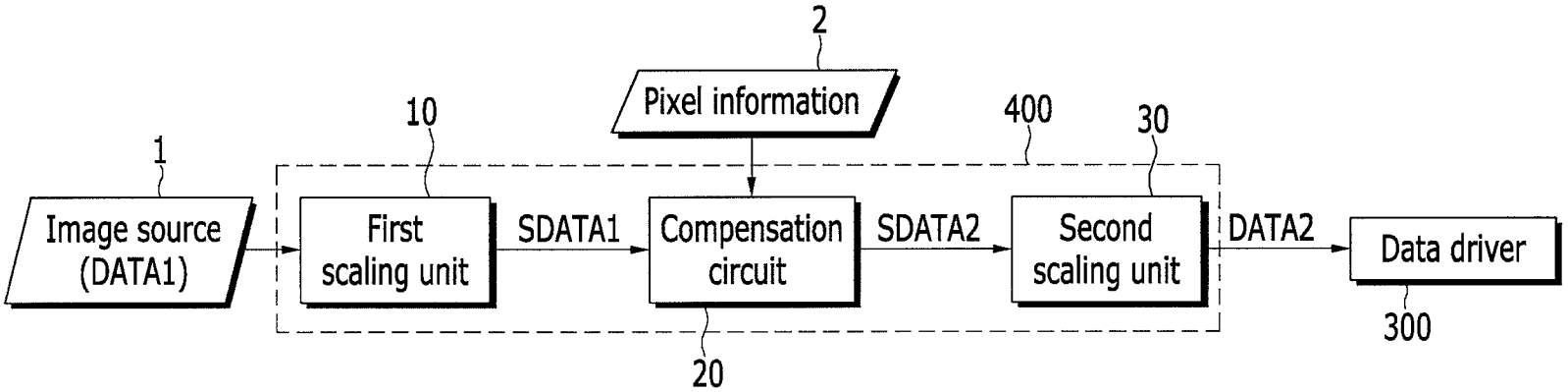
FIG. 2 is a block diagram of configuration of an exemplary image compensation system included in a controller of the display device of FIG. 1.

FIG. 2 is an exemplary block diagram of the image compensation system of the controller 400 of FIG. 1. The image compensation system performs image compensation on the image source data DATA1.

The image compensation system of the display device according to the exemplary embodiment of FIG. 2 includes a first scaling unit 10, a compensation circuit 20, and a second scaling unit 30. The image data signal DATA2 is compensated after the image data is compensated in the controller 400 of the image compensation system. The image data signal DATA2 is transmitted to the data driver 300, which is a driving circuit.

A display device includes the display unit 100 formed of pixels and each of the pixels includes a self-emissive element such as an OLED. The display device converts a voltage or a current to another driving current flowing through the OLED to display an image. The driving current makes the OLED to emit light and is determined corresponding to the image data signal. The display device generates the image data signal by processing the image source data transmitted from the external image source.

The image source data contains various information related to image display of a pixel, such as luminance or a color coordinate. However, the image information of the luminance or the color coordinate included in the image source data may not be accurate due to a non-uniformity characteristic of the display unit. Although the image source data have the same luminance or color coordinates, pixels may be deteriorated or aged variously and irregularly depending on characteristics of the pixels of the display device.

In order to solve such luminance non-uniformity, a conventional display device performs image process to display an image with desired luminance (target luminance) according to the original image data and compensates original image data based on the pixel characteristics. However, the compensation is accurate only when specific information of a pixel measured for a predetermined brightness condition is available. The compensation may be inaccurate under another brightness condition that depends on an external environment of the display device.

Therefore, the image compensation system according to an exemplary embodiment of the disclosed technology can flexibly perform luminance compensation for any brightness condition of an external environment.

As shown in FIG. 2, the controller 400 with the image compensation system according to an exemplary embodiment of the disclosed technology is disclosed. The image compensation system includes the first scaling unit 10 formed in a front end of the compensation circuit 20 and further includes the second scaling unit 30 formed at a rear end thereof to process data.

First, the first scaling unit 10 receives the image source data DATA1 and performs a predetermined data processing process. The image source data DATA1 is initially transmitted from the external image source. Hereinafter, the process for processing the image data, performed in the first scaling unit 10 is referred to as a first compensation process.

The externally supplied image source data 1 includes luminance data with respect to a display image. The first compensation process is a process for generating a first compensation data SDATA1 by converting luminance data of the image source data DATA1 1.

That is, the first scaling unit 10 controls an input image source data 1 according to predetermined reference brightness. In this case, the reference brightness implies brightness when that predetermined pixel information 2 is measured in the display device.

In further detail, the first compensation process will be described with reference to the graph shown in FIG. 3. The graph of FIG. 3 illustrates a relationship of a luminance value L with respect to gray data of an image signal.

Figure 3:
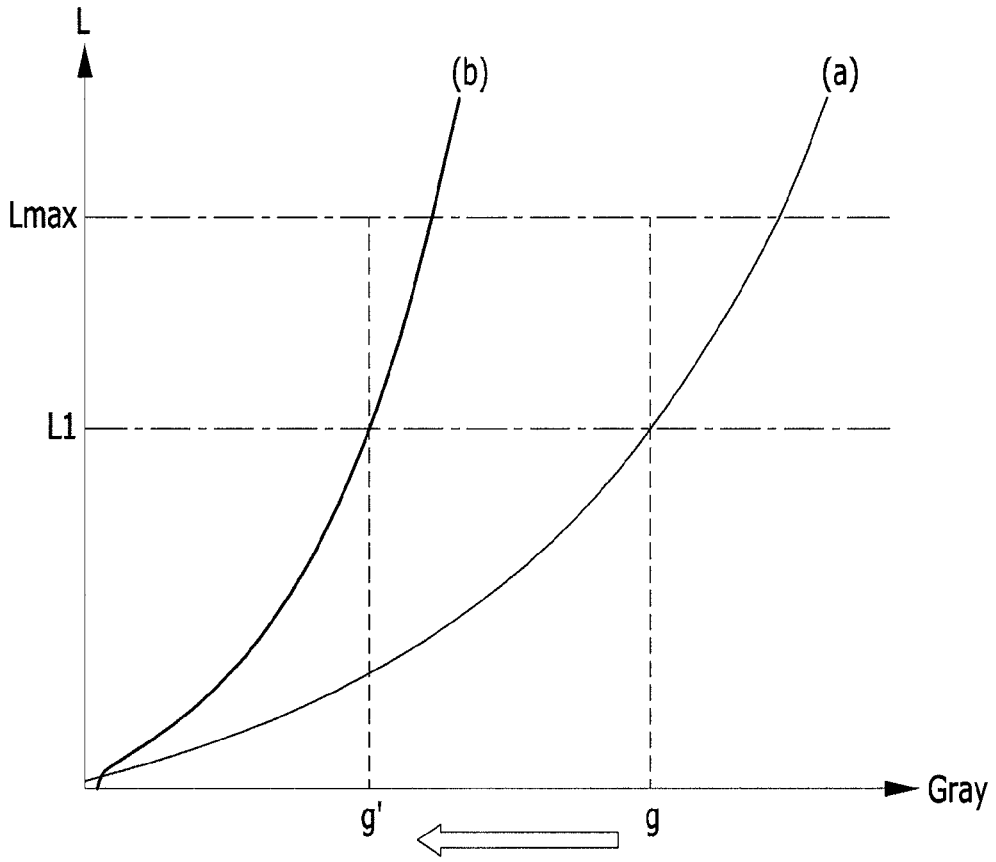
FIG. 3 is a graph illustrating a method for processing image data in a first scaling unit of FIG. 2.

As shown in the graph of FIG. 3, the gray data of the input source data 1 input to the first scaling unit 10 has a value of g and the first scaling unit 10 converts the value of g to g', which is scaled gray data by applying a first compensation equation. This is conversion of gray data of a current input image source data. The current input image source data is converted into a value corresponding to a brightness condition under which pixel information is measured. In other words, the gray data g of the current input image source data is converted to the gray data g'. that the gray data g' corresponds to the reference brightness condition under which pixel information of the same luminance value L1 is measured. Referring to the graph of FIG. 3, a gray-luminance relationship curved line is moved to (b) from (a) due to compensation of the first scaling unit 10. Therefore, the display unit of the display device may display an image with luminance brighter than the present brightness condition under which an image source data is being input.

The first scaling unit 10 may be an operation circuit that may adopt the first compensation equation for controlling gray data. The gray data correspond to the brightness condition under which the pixel information is measured. A detailed operation circuit may have various designs and therefore no further description will be provided.

The first compensation equation employed by the first scaling unit 10 is as given in Equation 1.

$$g' = g \times \left(\frac{Nbrt}{Rbrt}\right)^{\frac{1}{\gamma}} \qquad \text{Equation 1}$$

where g' denotes first compensation data which is controlled gray data, g denotes gray data of the image source data 1, R brt denotes reference brightness when pixel information is measured in the display device, N brt denotes a specific present brightness condition set by the display unit of the display device, and γ denotes a unique gamma value of the display unit.

The first compensation data SDATA1 controlled by the first scaling unit 10 is transmitted to the compensation circuit 20. In the compensation circuit 20, a predetermined data processing process is performed with respect to the first input compensation data SDATA1 using pixel information 2 measured by the display unit of the display device. In this case, the compensation circuit 20 performs compensation for luminance non-uniformity of the display device, and such an image data processing process is referred to as a second compensation process.

The compensation circuit 20 compensates for the first compensation data SDATA1 input through the second compensation process and outputs second compensation data SDATA2. Here, the compensation circuit 20 uses pixel information 2 that is measured in the predetermined reference brightness.

The pixel information 2 implies the degree that a luminance value output from original gray data is different from a target luminance value. This may be due to a material characteristic, a manufacturing environment, and/or a structural characteristic of pixels that forms the display device. That is, the pixel information implies a parameter that compensates a luminance difference. Therefore, the parameter of the pixel information 2 may be measured with various variables rather than predetermined to a specific value. The pixel information may not be measured with respect to all the pixels. Instead, a pixel located in a representative location is selected and characteristic information of the selected pixel may be acquired.

The compensation circuit 20 compensates for a substantially displayed luminance value to be equivalent to a target luminance value of gray data using the pixel information 2. Therefore, the structure of the circuit may be modified rather than being fixed to a specific structure.

Figure 4:
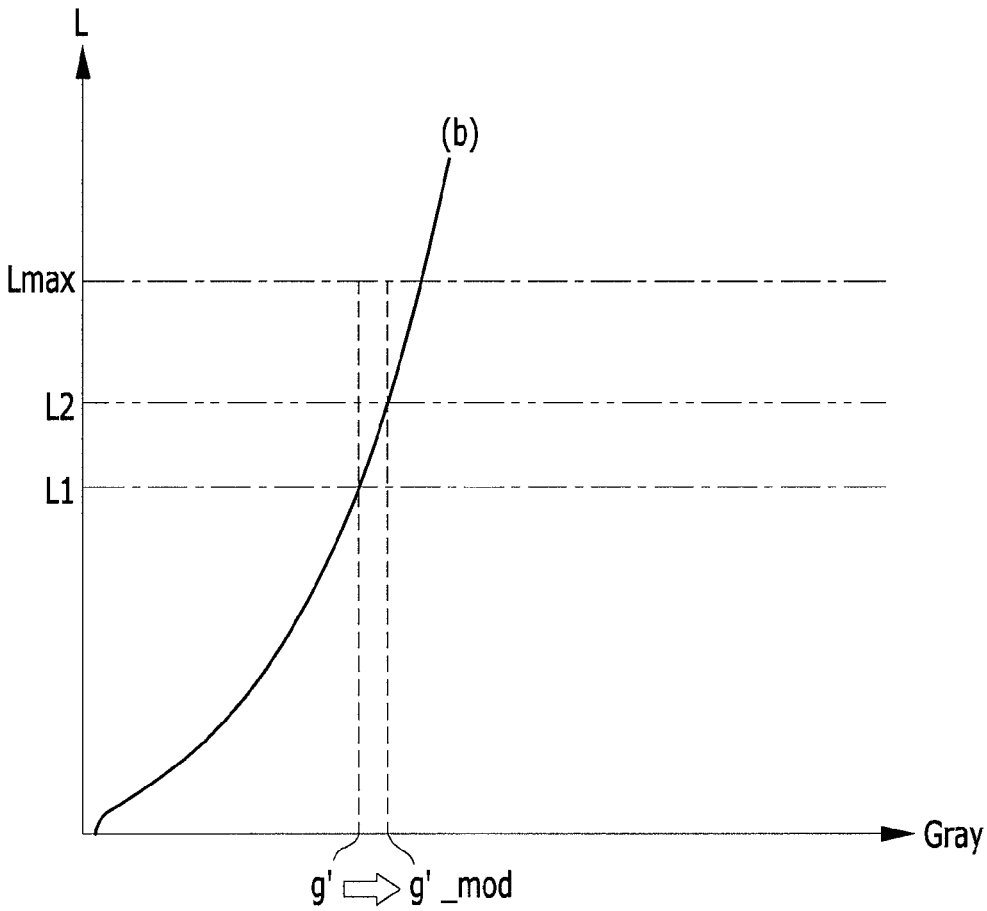
FIG. 4 is a graph illustrating a method for processing image data in a compensation circuit of FIG. 1.

In more details, the second compensation process may be described with reference to the graph shown in FIG. 4. As shown in the graph of FIG. 4, the first compensation data DATA1 input to the compensation circuit 20 already has a gray value of g' based on the reference brightness by the conversion in the first scaling unit 10 as shown in the graph of FIG. 3. In addition, the first compensation data SDATA1 is displayed with brightness of a luminance value L1 and the compensation circuit 20 modulates the first compensation data SDATA1 into the second compensation data SDATA2 using the measured pixel information in the display device.

The compensation circuit 20 compensates the gray value g' to g'_mod so as to display a target luminance value L2 when the present luminance corresponding to the gray value g' is L1.

According to the graph of FIG. 4, the second compensation process processed in the compensation circuit 20 is a process for converting a luminance value into a target luminance value L2 according to a curved line (b), which is a reference brightness condition at the time that the pixel information is measured.

The second compensation data SDATA2 output is transmitted to the second scaling unit 30 through the second compensation process of the compensation circuit 20.

The second scaling unit 30 performs a data processing process to re-modulate image data according to present brightness of the display unit. The image data is compensated with a target luminance value corresponding to gray data. Hereinafter, the data processing process is performed in the second scaling unit 30 with respect to the image data. The data processing process is referred to as a third compensation process.

The second scaling unit 30 receives the second compensation data SDATA2 and modulates the received second compensation data SDATA2 according to a predetermined brightness of the current display device by applying a predetermined equation and outputs the modulated data as the third compensation data DATA2. The second compensation data SDATA2 has been compensated to be outputted with a target luminance value corresponding to a reference brightness. The reference brightness is the brightness when the pixel information is measured in the compensation circuit unit 20.

Figure 5:
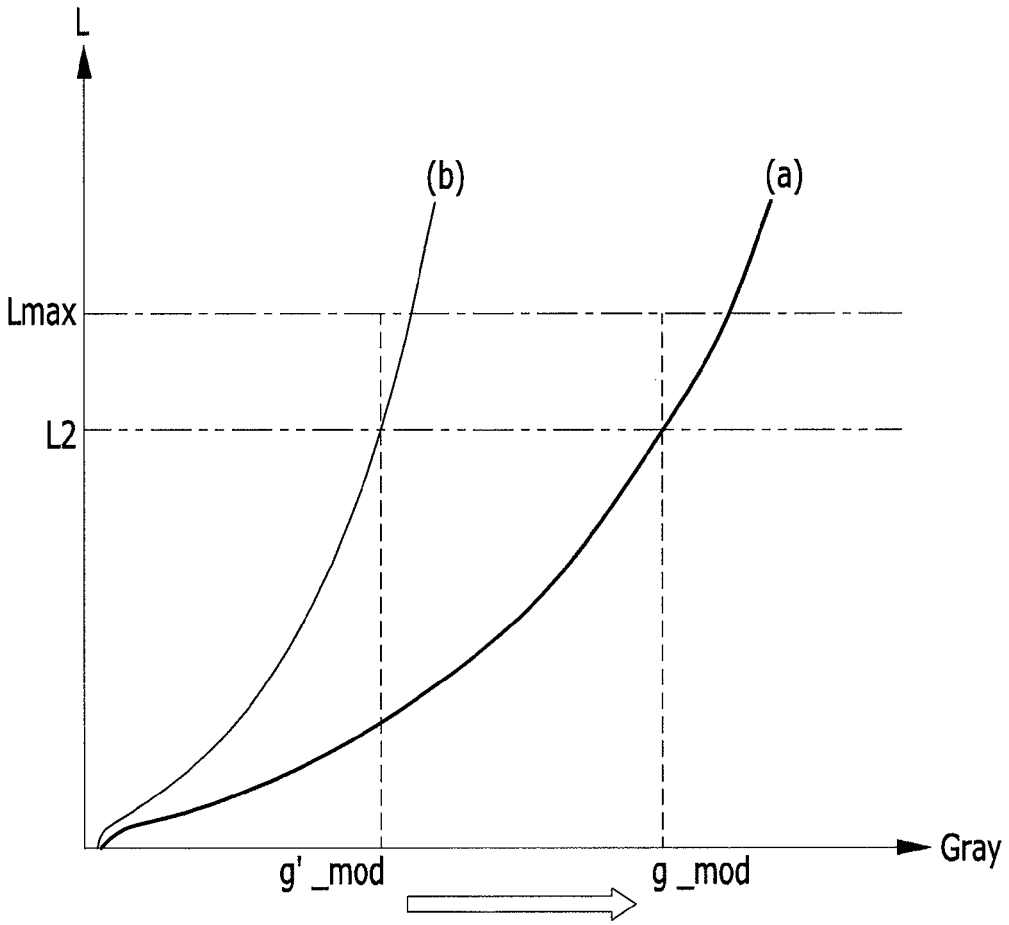
FIG. 5 is a graph illustrating a method for processing image data in a second scaling unit of FIG. 1.

The third compensation process may be described in details with reference to the graph of FIG. 5.

As shown in the graph of FIG. 5, gray data of the second compensation data SDATA input to the second scaling unit 30 has a value of g_mod through the second compensation process performed for luminance compensation. The second scaling unit 30 modulates the value of g'_mod into a value of g_mod. g_mod is gray data re-controlled by applying a second compensation equation.

This is to modulate the gray data back to a value corresponding to the present brightness condition of the display device. The gray data are compensated to be displayed with a target luminance value corresponding to a reference brightness at which pixel information is measured. In other words, the gray value g'_mod of the second compensation data SDATA2 is converted to the gray value g_mod. The second compensation data SDATA2 have been compensated with the predetermined target luminance value L2. g_mod corresponds to the present brightness condition of the display device displaying the same target luminance value L2.

Referring to the graph of FIG. 5, it can be observed that the relationship curved line between the gray and luminance is moved from (b) to (a) due to compensation of the second scaling unit 30. (a) corresponds to the original brightness condition of the display device before image data compensation. This implies that the gray-luminance relationship is changed back to the original brightness condition of the display device through the image compensation system according to the exemplary embodiment of the disclosed teachology.

The second scaling unit 30 may be an operation circuit formed of a circuit that adopts the second compensation equation and re-controls gray data corresponding to the present brightness condition of the display device. The operation circuit may be designed and implemented in various ways.

The second scaling unit 30 adopted by the second scaling unit 30 is as given in Equation 2.

$$\text{g_mod} = g'\text{_mod} \div \left(\frac{Nbrt}{Rbrt}\right)^{\frac{1}{\gamma}} \qquad \text{Equation 2}$$

Here, g_mod denotes third compensation data which is re-controlled gray data, g'_mod is the second compensation data compensated by the compensation circuit 20, R brt denotes a reference brightness when pixel information is measured, N brt is a current brightness set by the display unit of the display device, and γ is a unique gamma value of the display unit.

The Equation 2 divides a compensation rate $$\left(\left(\frac{Nbrt}{Rbrt}\right)^{\frac{1}{\gamma}}\left(\frac{Nbrt}{Rbrt}\right)^{\frac{1}{\gamma}}\right)$$

that has been multiplied for controlling of the data in the Equation 2 again so that the data modulated according to the original brightness of the display unit can be output.

The third compensation data DATA2 is transmitted to the data driver 300 which is a driving circuit of the display device.

The third compensation data DATA2 is further transmitted to the corresponding pixel of which operation is activated in respond to a scan signal transmitted to each pixel of the display unit 100.

The third compensation data DATA2 is output data to which data compensation is applied corresponding to present brightness of the display device before and after the operation of the compensation circuit unit 20. The compensation circuit unit 20 compensates data to be displayed with a target luminance corresponding to image source data initially input to the display device. Accordingly, the display image may be displayed with uniform and accurate luminance without regard to a brightness condition of the display device.

Figure 6:
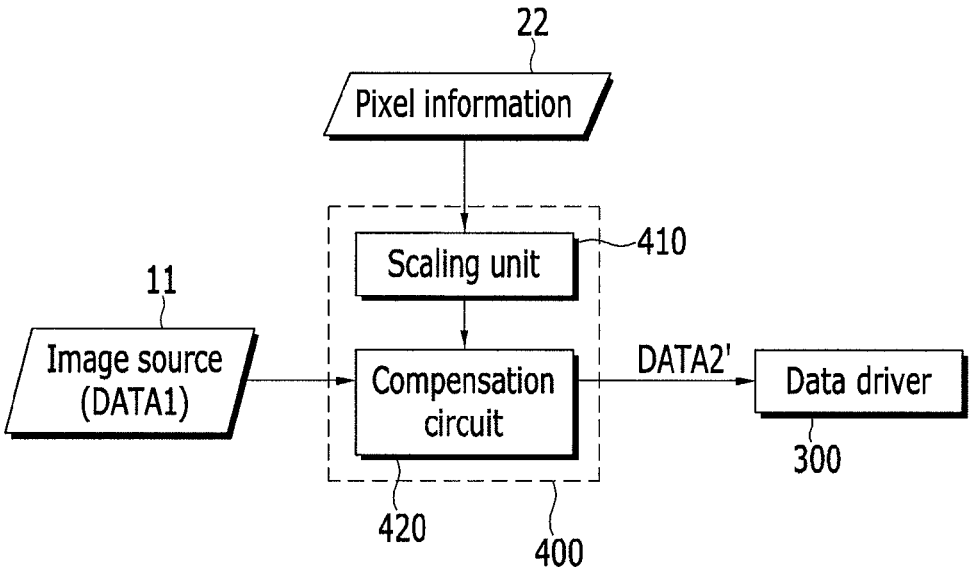
FIG. 6 is a block diagram of a configuration of another exemplary image compensation system, included in the controller of the display device of FIG. 1.

FIG. 6 is an exemplary schematic block diagram of an image compensation system according to another exemplary embodiment of the disclosed technology. The image compensation system is included in the controller 400 of the display device shown in FIG. 1.

Unlike the exemplary embodiment of FIG. 1, the image compensation system of the display device of FIG. 6 includes a compensation circuit unit 420 and at least one scaling unit 410. The scaling unit 410 connects to a front end of the compensation circuit unit 420. Thus, the image compensation system compensates image source data input to the controller 400, generates a compensated image data signal, and transmits the compensated image data signal to a data driver 300. The data driver 300 connects to a rear end of the compensation circuit unit 420.

In the image compensation system according to the exemplary embodiment of FIG. 6, image source data DATA1' 11 input through an external image source is transmitted to the compensation circuit unit 420.

The compensation circuit 420 is connected to the scaling unit 410, and compensates the image source data 11 using pixel information 22. The pixel information 22 is transmitted through the scaling unit 420 to output compensation data DATA2'.

Here, the pixel information 22 is a parameter for data compensation measured in a predetermined reference brightness. The pixel information 22 implies the degree that a luminance value output from original gray data is different from a target luminance value. This luminance value difference is due to a material characteristic, a manufacturing environment, and/or a structural characteristic of the pixels forming the display device. In other words, the pixel information implies a parameter that compensates a luminance difference In the exemplary embodiment of FIG. 5, the pixel information 22 is transmitted to the scaling unit 410.

The scaling unit 410 converts the pixel information 22 measured in the reference brightness to a value corresponding to the present brightness of a display unit of the display device. An equation adopted for pixel information conversion of the scaling unit 410 is not limited to any specific equation. The scaling unit 410 may be formed as various operation circuits for using such an equation.

The converted pixel information is transmitted to the compensation circuit unit 420. The compensation circuit unit 420 compensates the image source data DATA1' using the converted pixel information corresponding to the present brightness of the display unit. In other words, a luminance value of the substantially displayed image data is compensated to be equivalent to a target luminance value of the image source data using the converted pixel information. Thus, the compensation circuit unit 420 generates compensation data DATA2' and transmits the compensation data DATA2' to the data driver 300.

Like the exemplary embodiment of FIG. 2, the data driver 300 may generate a voltage according to the compensation data DATA2' and transmit the voltage to a corresponding pixel activated by transmitting the scan signal to each pixel of the display device. The data driver 300 transmits a data voltage according to the transmitted compensation data DATA2' to each corresponding pixels of the display device such that the pixel can display an image.

The compensation data DATA2' has been compensated to be displayed with a target luminance value using pixel information. The pixel information is converted corresponding to the present brightness of the display device from the pixel information measured in a reference brightness with respect to a predetermined pixel. Accordingly, a display image can be displayed uniformly and accurately without regard to the brightness condition of the display device.

For purposes of summarizing the disclosed technology, certain aspects, advantages and novel features of the disclosed technology have been described herein. It is to be understood that not necessarily all such advantages may be achieved in accordance with any particular embodiment of the disclosed technology. Thus, the disclosed technology may be embodied or carried out in a manner that achieves or optimizes one advantage or group of advantages as taught herein without necessarily achieving other advantages as may be taught or suggested herein.

Various modifications of the above described embodiments will be readily apparent, and the generic principles defined herein may be applied to other embodiments without departing from the spirit or scope of the disclosed technology. Thus, the disclosed technology is not intended to be limited to the embodiments shown herein but is to be accorded the widest scope consistent with the principles and novel features disclosed herein.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims. Therefore, those skilled in the art can easily select and substitute the drawings and disclosed description. Those skilled in the art can omit some of the constituent elements described in the present specification without deterioration in performance thereof or can add constituent elements to improve performance thereof. Furthermore, those skilled in the art can modify the sequence of the steps of the method described in the present specification depending on the process environment or equipment. Therefore, the scope of the disclosed technology must be determined by the scope of the claims and the equivalent, not by the described embodiments.

What is claimed is:

1. A display device for displaying an image by transmitting an image data signal from an external source to a display unit including pixels, the display device comprising:

a controller configured to receive the image data, process the image data signal based at least in part on at least one of pixel information, a reference brightness condition of the display device, a present brightness of the display device and a target luminance, and generate final compensated data, the pixel information measured under the reference brightness condition; and a data driver configured to transmit the final compensated data to an activated driving pixel, wherein the controller comprises:

a first scaling circuit configured to receive the image data signal from the external source and scale the image data signal based at least in part on the reference brightness condition and the pixel information so as to generate first compensation data;

a compensation circuit configured to compensate gray data of the first compensation data, to generate second compensation data configured to display a target luminance based at least in part on the image data signal and the pixel information; and a second scaling circuit configured to scale the second compensation data based at least in part on the present brightness so as to generate the final compensated data.

2. The display device of claim 1, wherein the first scaling circuit and the second scaling circuit have operation circuits configured to perform calculations based at least in part on a compensation rate, and wherein the compensation rate is based at least in part on the present brightness and the reference brightness.

3. The display device of claim 2, wherein the compensation rate is based on a ratio between the present brightness and the reference brightness.

4. The display device of claim 1, wherein the first scaling circuit is further configured to generate the first compensation data by multiplying the compensation rate and the image data signal, and wherein the second scaling circuit is further configured to generate the final compensated data by dividing the second compensation data with the compensation rate.

5. The display device of claim 1, wherein the pixel information has information of a luminance difference between a luminance value generated from original gray data of the image data signal and a target luminance value.

6. The display device of claim 1, wherein the first scaling circuit is connected to a front end of the compensation circuit, and wherein the second scaling circuit is connected to a rear end of the compensation circuit.

7. The display device of claim 1, further comprising a scan driver configured to transmit scan signals to the pixels and sequentially activate corresponding pixels.

8. The display device of claim 1, wherein the data driver is further configured to enable displaying of the image.

9. A display device for displaying an image by transmitting an image data signal from an external source to a display unit including pixels, the display device comprising:

a controller configured to receive the image data signal, process the image data signal based at least in part on pixel information, a predetermined brightness condition of the display unit, a present brightness condition of the display unit and a target luminance, and generate an output image data signal, the pixel information measured under the predetermined brightness condition; and a data driver configured to transmit the output image data signal to an activated driving pixel of the pixels, wherein the controller comprises:

a first scaling circuit configured to receive the image data signal from the external source and scale the image data signal based at least in part on the reference brightness condition and the pixel information so as to generate first compensation data;

a compensation circuit configured to compensate gray data of the first compensation data, to generate second compensation data for displaying a target luminance based at least in part on the image data signal and the pixel information; and a second scaling circuit configured to scale the second compensation data based at least in part on the present brightness condition so as to generate the output image data signal.

10. The display device of claim 9, wherein the pixel information is a parameter based at least in part on a luminance difference between a luminance value generated from original gray data of the image data signal and the target luminance value.

11. The display device of claim 9, further comprising a scan driver configured to transmit scan signals to the pixels and sequentially activate corresponding pixels.

12. An image compensation method of compensating an image data signal in a display device that displays an image by transmitting the image data signal from an external source to a display unit including pixels, the image compensation method comprising:

measuring pixel information of the pixels in a reference brightness;

calculating a compensation rate based at least in part on a ratio between a present brightness of the display unit and the reference brightness;

performing a first compensation process by applying the compensation rate to the image data signal and generating first output data;

performing a second compensation process based at least in part on the pixel information, the first output data and a target luminance to generate second output data;

performing a third compensation process by scaling the second output data based at least in part on the present brightness and the compensation rate so as to generate third output data; and displaying the image by transmitting the third output data to each of the pixels.

13. The image compensation method of claim 12, wherein performing the first compensation process comprises performing an operation of multiplying the compensation rate to the image data signal, and wherein performing the third compensation process comprises performing an operation of dividing the second output data with the compensation rate.

14. The image compensation method of claim 12, wherein the pixel information is a parameter based at least in part on a luminance difference between a luminance value generated from original gray data of the image data signal and a target luminance value, and wherein the luminance difference is caused by at least one of a material characteristic, a manufacturing environment and a structural characteristic of the pixels.

15. An image compensation method of compensating an image data signal in a display device for displaying an image by transmitting the image data signal from an external source to a display unit including pixels, the image compensation method comprising:

measuring pixel information of pixels under a reference brightness condition;

acquiring the pixel information and converting the pixel information based at least in part on a present brightness condition of the display unit;

performing a compensation for a target luminance based at least in part on the image data signal and the converted pixel information; and displaying the image by transmitting a compensated image data signal to the pixels, wherein the performing includes:

performing a first compensation process by applying a compensation rate to the image data signal and generating first output data;

performing a second compensation process based at least in part on the pixel information, the first output data and the target luminance to generate second output data;

performing a third compensation process by scaling the second output data based at least in part on the present brightness condition and the compensation rate so as to generate the compensated image data signal.

16. The image compensation method of claim 15, wherein the pixel information is a parameter based at least in part on a luminance difference between a luminance value generated from original gray data of the image data signal and a target luminance value, and wherein the luminance difference is caused by at least one of a material characteristic, a manufacturing environment and a structural characteristic of the pixels.

17. The display device of claim 1, wherein the second scaling circuit is further configured to increase a gray scale value of the second compensation data.

* * * * *